US011164705B2

(12) United States Patent
Lin et al.

(10) Patent No.: US 11,164,705 B2
(45) Date of Patent: Nov. 2, 2021

(54) SWITCHING APPARATUS AND ASSOCIATED SWITCH

(71) Applicant: ABB Schweiz AG, Baden (CH)

(72) Inventors: Zeming Lin, Xiamen (CN); Hengjie Guo, Xiamen (CN); Aki Suutarinen, Helsinki (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/820,089

(22) Filed: Mar. 16, 2020

(65) Prior Publication Data

US 2020/0279698 A1 Sep. 3, 2020

Related U.S. Application Data

(63) Continuation of application No. PCT/CN2018/105825, filed on Sep. 14, 2018.

(51) Int. Cl.
*H01H 9/20* (2006.01)
*H01H 9/54* (2006.01)

(52) U.S. Cl.
CPC ..... *H01H 9/20* (2013.01); *H01H 9/54* (2013.01)

(58) Field of Classification Search
CPC ..... H01H 9/20; H01H 9/54; H01H 9/26
(Continued)

(56) References Cited

U.S. PATENT DOCUMENTS 3,185,783 A * 5/1965 Dowdle ..... H01H 9/285 200/43.13
4,071,722 A * 1/1978 Hart ..... H01H 9/20 200/50.1

(Continued)

FOREIGN PATENT DOCUMENTS

CN 200969293 Y 10/2007
CN 104124112 A 10/2014

(Continued)

OTHER PUBLICATIONS

State Intellectual Property Office of the P.R. China, International Search Report & Written Opinion issued in corresponding Application No. PCT/CN2018/105825, dated Nov. 14, 2018, 8 pp.

(Continued)

*Primary Examiner* — Anthony R Jimenez
*Assistant Examiner* — Lheiren Mae A Caroc
(74) *Attorney, Agent, or Firm* — Taft Stettinius & Hollister LLP

(57) ABSTRACT

Implementations of the subject matter described herein provide an apparatus for use in a switch. The apparatus includes: a handle including a first slot; a mode button operable to change an operation mode of the switch, the mode button including a second slot; a slider coupled to the mode button and movable in a first direction in association with a movement of the mode button, the slider including a first block; a lever operable to be opened in a rotatable manner and including a pin, wherein when the mode button is set at a service position, the first block is received in the first slot to maintain the handle; and in response to the lever being opened in the rotatable manner, the pin is operable to pass through the second slot to prevent the movement of the mode button. Such apparatus herein provides a lock mechanism that may prevent mistake operation between different operation modes.

18 Claims, 5 Drawing Sheets

(58) Field of Classification Search
USPC ..... 200/50.01, 50.03–50.06, 50.11, 50.12, 200/50.16, 50.18, 50.19, 50.32, 50.33, 200/50.36, 50.37, 50.4, 547, 551
See application file for complete search history.

(56) References Cited

U.S. PATENT DOCUMENTS

| | | | | |
|---|---|---|---|---|
| 5,023,469 | A * | 6/1991 | Bassett | H01H 9/26 307/64 |
| 5,504,284 | A | 4/1996 | Lazareth et al. | |
| 7,531,761 | B2 * | 5/2009 | Carson | H01H 9/22 200/50.02 |

FOREIGN PATENT DOCUMENTS

| | | | |
|---|---|---|---|
| CN | 104465161 | A | 3/2015 |
| CN | 205428754 | U | 8/2016 |
| JP | H10134693 | A | 5/1998 |

OTHER PUBLICATIONS

European Patent Office, Extended European Search Report issued in corresponding European application No. 18856588.1, dated May 25, 2021, 5pp.

* cited by examiner

SWITCHING APPARATUS AND ASSOCIATED SWITCH

CROSS-REFERENCE TO RELATED APPLICATION

The present application claims priority to Chinese Patent Application No. 201710833952.5 entitled "SWITCHING APPARATUS AND ASSOCIATED SWITCH" filed on Sep. 15, 2017, which is incorporated herein by reference in its entirety and constitutes a part of the present application.

TECHNICAL FIELD

Various embodiments generally relate to a switching apparatus and an associated switch.

BACKGROUND

Automatic transfer switches (ATS) can provide different operation modes including electrical (or automatic) operation mode and manual operation mode. However, in some circumstances, mis-operation between different operation modes may occur and cause safety accident. Therefore, a lock mechanism is expected to disable the electrical operation, especially when the switch is operated under a manual operation mode. Moreover, when the switch is operated under a service mode (also referred to as padlock mode), both of electrical operation and manual operation are expected to be disabled by the lock mechanism.

SUMMARY

Implementations of the subject matter described herein provide a lock mechanism that may prevent mistake operation between different operation modes. Particularly, such lock mechanism may disable the electrical operation when the switch is operated under a manual operation mode. Moreover, such lock mechanism may disable both of electrical operation and manual operation when the switch is operated under a service mode. In this way, the mis-operation between different operation modes can be effectively avoided, thereby improving the safety for the operator who is operating the switch.

In first aspect of present disclosure, an apparatus for use in a switch is provided. The apparatus includes: a handle including a first slot; a mode button operable to change an operation mode of the switch, the mode button including a second slot; a slider coupled to the mode button and movable in a first direction in association with a movement of the mode button, the slider including a first block; a lever operable to be opened in a rotatable manner and including a pin, wherein when the mode button is set at a service position, the first block is received in the first slot to maintain the handle; and in response to the lever being opened in the rotatable manner, the pin is operable to pass through the second slot to prevent the movement of the mode button.

In this way, a compact internal structure design is enabled. Moreover, when the switch is operated under the service mode, the handle can be locked in position, so that the operator cannot pull it out. In the meantime, the mode button can also be locked in position, so that the operator cannot move it to other positions any more.

In some implementations, the apparatus may further include: a first signal generator; and a second signal generator, wherein the lever further includes a cam, and the slider further includes a second block, wherein in response to the pin passing through the second slot, the cam is operable to press the first signal generator to trigger the first signal generator, and the second block is operable to press the second switch to trigger the second signal generator. The triggered first signal generator and the triggered second signal generator are configured to indicate that the mode button is set the service position. In this way, the electrical operation will be securely forbidden.

In some implementations, the apparatus may further include: a torsion spring coupled to the lever and operable to apply a torsional force against an opening of the lever, wherein the lever further includes at least one hole operable to receive a padlock, to facilitate in maintaining the lever at its opening status. In this way, when the lever is released, the lever can automatically bounce back to the folded-up status.

In some implementations, the apparatus may further include: a rod arranged against the handle in a second direction; and a first pressure spring coupled to the rod and operable to apply an elastic force to the rod in a positive second direction, wherein when the mode button is set at a manual position, the first block is operable to be released from the first slot to enable the rod to push the handle away from a frame of the apparatus via the applied elastic force. The combination of the rod and the pressure spring, along with the fitting between the slot and the first block enables an easy and cost-effective way to lock and release the handle.

In some implementations, the rod includes a hook, and wherein when the mode button is set at the manual position, the hook is operable to extend along the positive second direction via the applied elastic force, to stop a movement of the slider in a negative first direction.

In some implementations, the apparatus may further include: a second pressure spring arranged in the first direction, with one end coupled to the mode button and the other end coupled to the frame, wherein when the mode button is set the manual position, the second pressure spring is operable to apply an elastic force to the mode button in the negative first direction.

In some implementations, when the handle is back to the frame, the handle is operable to push the rod in a negative second direction to cause the hook to move away from the slider, so as to allow the movement of the slider in the negative first direction, and the second pressure spring is operable to cause the movement of the mode button to the service position. In this way, the mode button will automatically go back to the service position, upon the handle is pushed back to the folded-up status.

In some implementations, when the mode button is set the manual position, the cam is operable to release the first signal generator, and the second block is operable to press the second switch to trigger the second signal generator, and the non-triggered first signal generator and the triggered second signal generator are configured to indicate that the mode button is set the manual position.

In some implementations, when the mode button is set an automatic position, the cam is operable to release the first signal generator, and the second block is operable to release the second switch, and the non-triggered first signal generator and the non-triggered second signal generator are configured to indicate that the mode button is set the automatic position. In this way, the electrical operation is enabled.

In second aspect of present disclosure, a switch is provided. The switch includes the apparatus according to the first aspect of the present disclosure.

It is to be understood that the Summary is not intended to identify key or essential features of implementations of the subject matter described herein, nor is it intended to be used to limit the scope of the subject matter described herein. Other features of the subject matter described herein will become easily comprehensible through the description below.

BRIEF DESCRIPTION OF THE DRAWINGS

The above and other objectives, features and advantages of the subject matter described herein will become more apparent through more detailed depiction of example implementations of the subject matter described herein in conjunction with the accompanying drawings, wherein in the example implementations of the subject matter described herein, same reference numerals usually represent same components.

Throughout the drawings, the same or similar reference symbols are used to indicate the same or similar elements.

DETAILED DESCRIPTION

The subject matter described herein will now be discussed with reference to several example implementations. It should be understood these implementations are discussed only for the purpose of enabling those skilled persons in the art to better understand and thus implement the subject matter described herein, rather than suggesting any limitations on the scope of the subject matter.

As used herein, the term "includes" and its variants are to be read as open terms that mean "includes, but is not limited to." The term "based on" is to be read as "based at least in part on." The term "one implementation" and "an implementation" are to be read as "at least one implementation." The term "another implementation" is to be read as "at least one other implementation." The terms "first," "second," and the like may refer to different or same objects. Other definitions, explicit and implicit, may be included below. A definition of a term is consistent throughout the description unless the context clearly indicates otherwise.

Figures 1A, 1B:
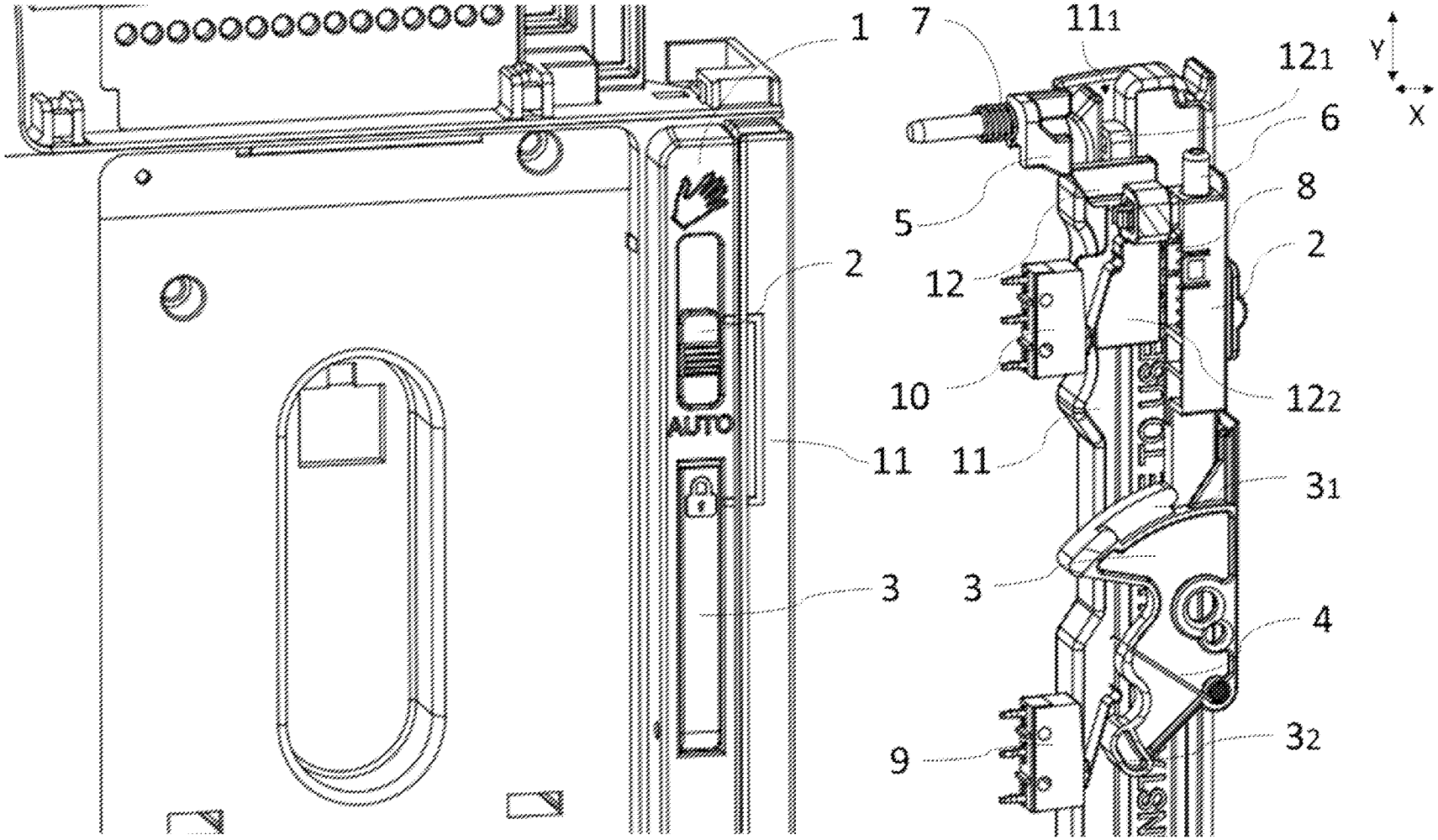
FIG. 1A is a perspective view of a switch including the apparatus according to an implementation of the present disclosure.
FIG. 1B is a perspective view of the apparatus under an automatic mode, according to an implementation of the present disclosure.

FIG. 1A is a perspective view of a switch including the apparatus according to various implementations of the present disclosure. As shown in FIG. 1A, from the operational point of view, the apparatus generally includes a mode button 2 and a lever 3 which are surrounded by a frame 1. The mode button 2 is operable to receive the user's operation for changing/switching the operation mode of the switch among various operation modes. The lever 3 is particularly used in the service mode and operable to be opened in a rotatable manner. The apparatus further includes a handle 11, and the handle 11 is only operable under the manual mode.

In this example, the mode button 2 is arranged on top of the lever 3, and the handle 11 is in a form of a strip extending in the longitudinal direction and arranged adjacent to the mode button 2 and the lever 3. At the automatic position as shown in FIG. 1A, the handle 11 is received within the housing of the switch, so that it is substantially coplanar with the frame 1. In the meantime, as shown in FIG. 1A, the lever 3 is folded-up/retracted within the housing (not pulled out), so that the lever 3 and the frame 1 are also substantially coplanar.

Figures 4A, 4B, 4C:
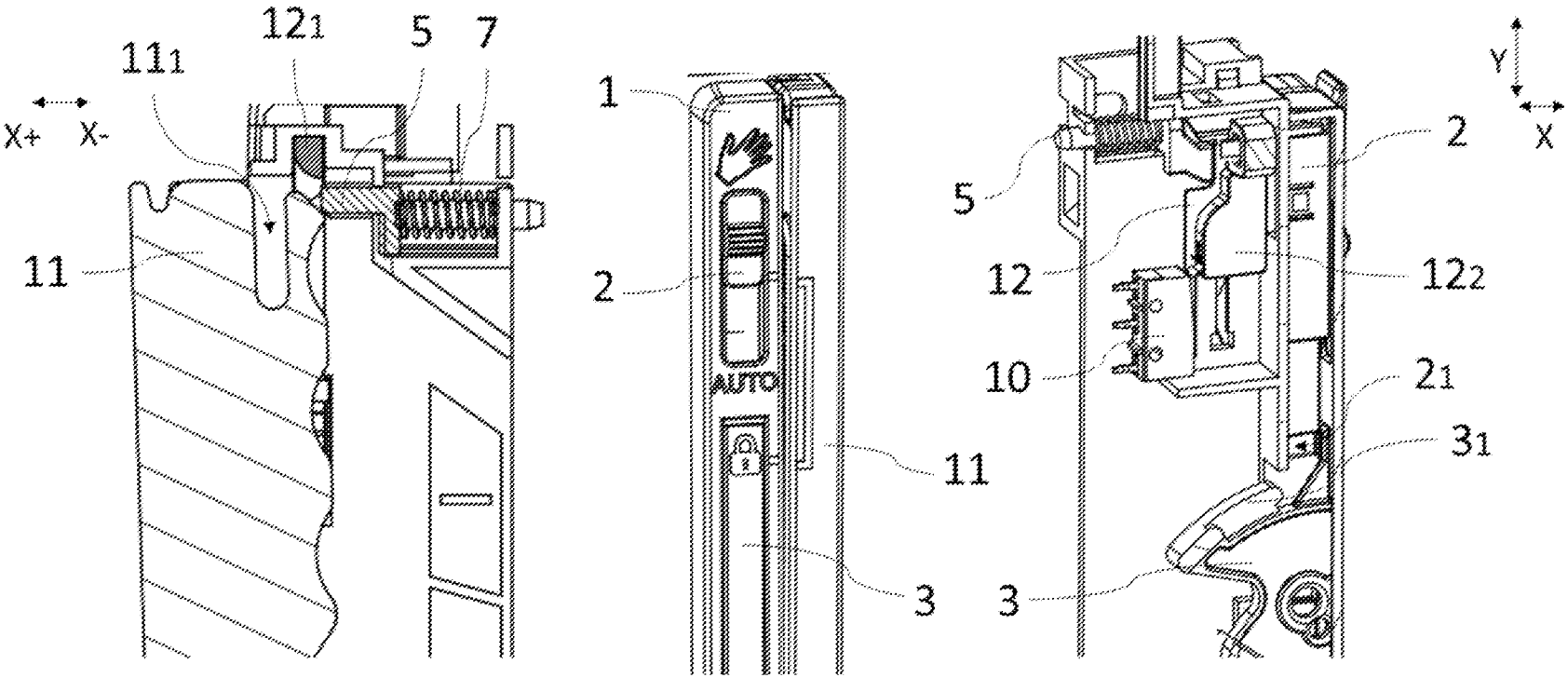
FIGS. 4A-4C show different views of the apparatus under a manual mode, according to implementations of the present disclosure.

FIG. 1B shows the internal structure of the apparatus as shown in FIG. 1A. As shown, the handle 11 includes a first slot $\mathbf{11}_1$ on its top portion, the mode button 2 includes a second slot $\mathbf{2}_1$ (as shown in FIG. 4C) at its lower portion, and the lever 3 includes a pin $\mathbf{3}_1$. As further depicted in FIG. 1B, the apparatus further includes a slider 12 having a first block $\mathbf{12}_1$ at its top portion. The slider 12 is coupled to the mode button 2 and movable in a first direction Y in association with a movement of the mode button 2. In an example implementation, the slider 12 is rigidly coupled with the mode button 2 and always moves together with the mode button 2. Throughout the present disclosure, the first direction Y is defined as the vertical direction.

Figure 2:
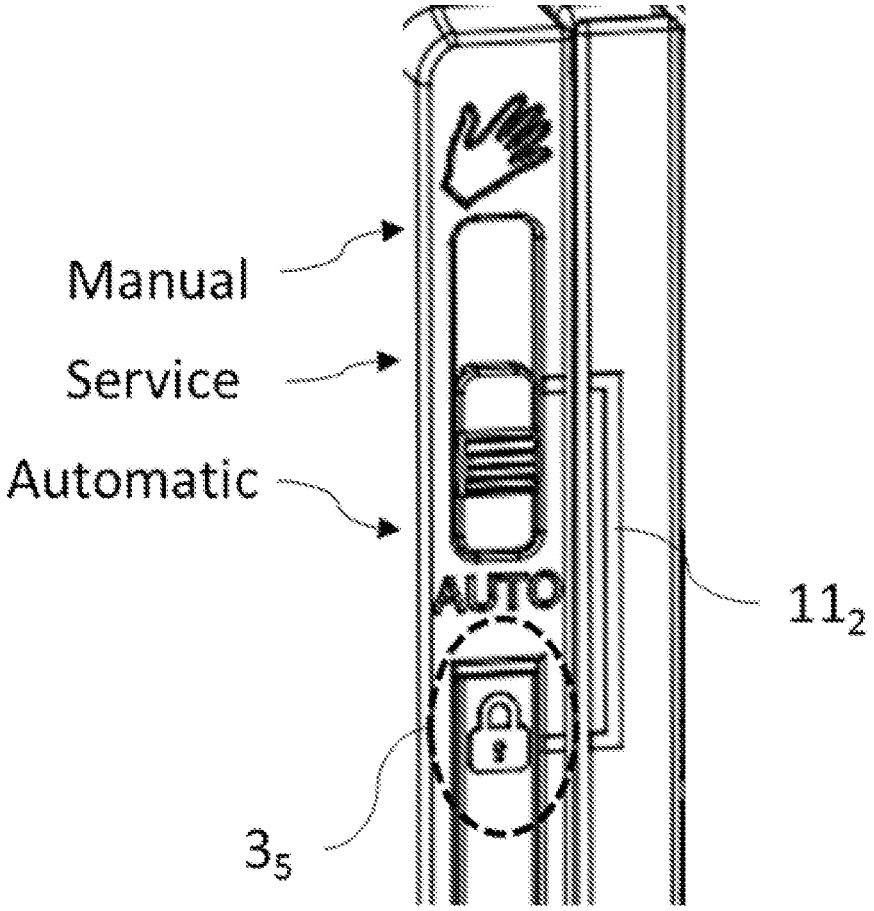
FIG. 2 shows a partial view of the switch in FIG. 1A with three operation modes.

The switch according to various implementations of the present disclosure provides three different operation modes for different application situations, namely, the manual mode, the service mode (hereafter may also be referred to as the padlock mode), and the automatic mode. For each of operation modes, the mode button 2 needs to be moved to the corresponding position, namely, the manual position, the service position (hereafter may also be referred to as the padlock position), and the automatic position, respectively. In the example as illustrated in FIG. 2, the manual position is the upper position, the service position is the middle position, and the automatic position is the bottom position. As further illustrated in FIG. 2, the handle 11 further includes a line symbol $\mathbf{11}_2$, with one end terminated at the service position, and the other end terminated at the padlock symbol 35 on the lever 3. The line symbol $\mathbf{11}_2$ indicates that the padlock function is only available when the mode button 2 is switched at the service position.

It is to be understood that FIG. 2 only shows an example arrangement of the corresponding positions of the mode button 2 under different operation modes. Depending on actual requirements or internal design, other position arrangements of different operation modes may also be envisaged.

Referring back to FIG. 1B where the apparatus is under the automatic mode, and the mode button 2 is set at the automatic position accordingly. As shown, when the mode button 2 is set at the automatic position (or the bottom position), the first block $\mathbf{12}_1$ is received in the first slot $\mathbf{11}_1$ of the handle 11 to maintain the handle 11 in the vertical orientation, so that the handle 11 is locked in position. Since the operator cannot take the handle 11 out, the manual operation is prevented.

Figures 3A, 3B, 3C:
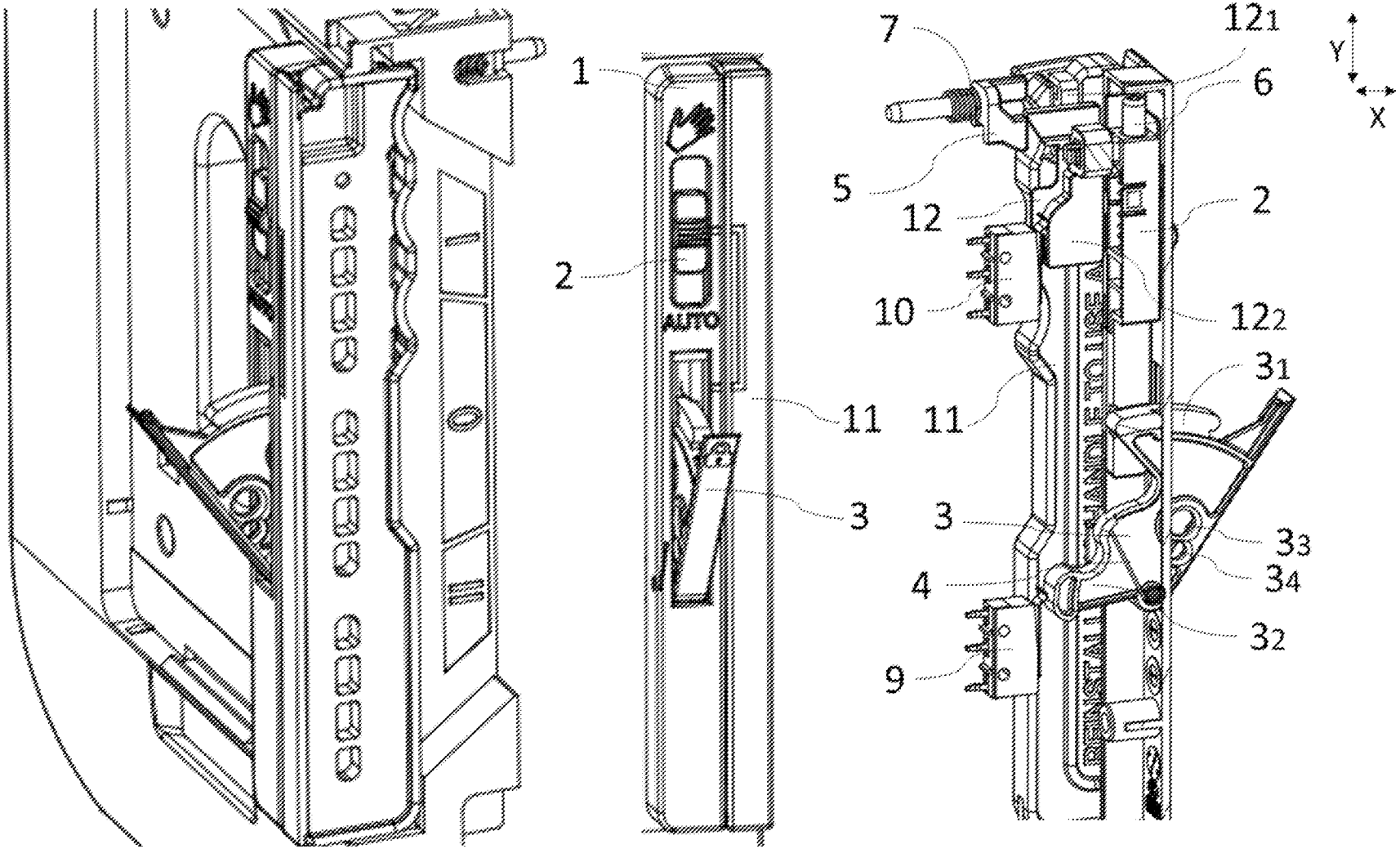
FIGS. 3A-3C show different views of the apparatus under a service mode, according to implementations of the present disclosure.

Now referring to FIGS. 3A-3C, FIGS. 3A-3C show different views of the apparatus working under the service mode. As shown in FIG. 3C, when the mode button 2 is switched from the automatic mode to a service position (or the middle position), the first block $\mathbf{12}_1$ is still received in the first slot $\mathbf{11}_1$ to maintain (or lock) the handle 11 in position. In the meantime, for safety, the lever 3 can be pulled to open in the rotatable manner, which allows the pin $3_1$ of the lever 3 to pass through the second slot $2_1$ of the mode button 2 to prevent the movement of the mode button 2. In this way, the mode button 2 can be securely locked at the service position, while the handle 11 likewise can be securely locked so that the handle 11 cannot be pulled out by the operator. As such, a lock mechanism can be achieved at the service position, which prevents both of electrical operation and manual operation.

Still referring to FIG. 3C, the apparatus further includes a first signal generator 9 and a second signal generator 10. The lever 3 further includes a cam $3_2$, and the slider 12 further includes a second block $12_2$. As discussed above, when the mode button 2 is set at the service position (or the middle position), the pin $3_1$ of the lever 3 can pass through the second slot $2_1$. As illustrated in FIG. 3C, when the pin $3_1$ passes through the second slot $2_1$, the cam $3_2$ is operable to press or load the first signal generator 9 to trigger the first signal generator 9, so as to inform the controller associated with the switch about the position of padlock lever 3.

As further illustrated in FIG. 3C, when the mode button 2 is set at the service position, the second block $12_2$ is also operable to press or load the second signal generator 10 to trigger the second signal generator 10. Although FIG. 3C illustrates a press-triggered (or load-triggered) type of signal generators 9 and 10, those skilled in the art should understand that a release-triggered type of signal generator is also possible, depending on various applications.

In this example, the first signal generator 9 is arranged to mainly monitor the padlock status. If only the first signal generator 9 is triggered, it indicates that the padlock has been pulled out, and both electrical (automatic) and manual operations are unavailable. The second signal generator 10 is arranged to monitor the handle status. If only the second signal generator 10 is triggered, it indicates that the handle 11 has been released or unlocked. If the first signal generator 9 and the second signal generator 10 are both triggered, it indicates that the mode button 2 has been set the service position.

Still referring to FIG. 3C, in some implementations, the apparatus further includes a torsion spring 4. The torsion spring 4 is coupled to the lever 3 and operable to apply a torsional force against the opening of the lever 3. In some implementations, the lever 3 may further include one or more holes for receiving a padlock. The insertion of the padlock may facilitate in maintaining the lever 3 at its opening status. In this example as illustrated in FIG. 3C, the lever 3 includes two holes $3_3$, $3_4$. In some implementations, the two holes $3_3$, $3_4$ may have different sizes, such as 6 mm and 4 mm in diameter, to receive different-sized padlocks.

Now referring to FIG. 4A, FIG. 4A shows a cross-sectional view of the apparatus under a manual mode. As shown, the apparatus further includes a rod 5 and a first pressure spring 7 coupled to the rod 5. The rod 5 is arranged against the handle 11 in a second direction X, and the first pressure spring 7 is operable to apply an elastic force to the rod 5 in a positive second direction X+, when the first pressure spring 7 is compressed. In this text, the second direction X is defined as the horizontal direction, and the positive second direction X+ is defined as the horizontal direction pointing out of the switch.

When the mode button 2 is set at the manual position (or the top position) as shown FIG. 4B, the first block $12_1$ is operable to be released from the first slot $11_1$. In this case, the rod 5 can push the handle 11 away from the frame 1 via the above-mentioned applied elastic force caused by the recovery of the pressure spring 7. In this way, the handle 11 can be "ejected" outwards so that the operator may easily pull it out. The combination of the rod 5 and the pressure spring 7, along with the fitting between the slot $11_1$ and the first block $12_1$ enables an easy and cost-effective way to lock and release the handle 11.

Figure 5B:
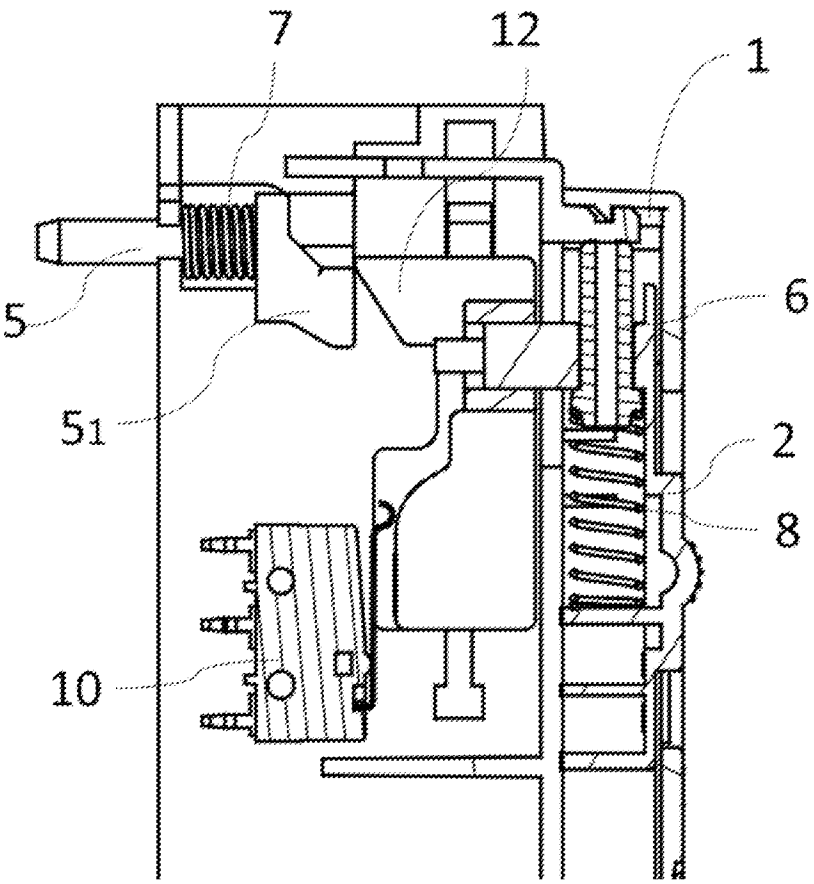
FIG. 5B show a cross-sectional view of the apparatus under service manual mode, according to implementations of the present disclosure.
Figure 5A:
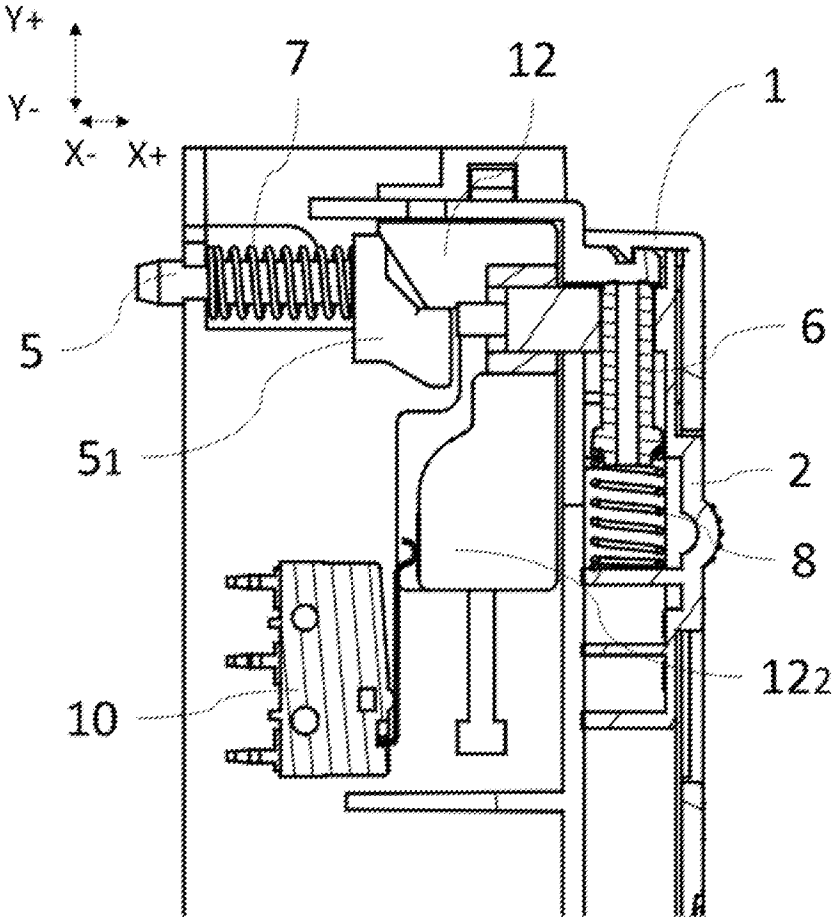
FIG. 5A show a cross-sectional view of the apparatus under the manual mode, according to implementations of the present disclosure.

Now referring to FIG. 5A, in some implementations, the rod 5 includes a hook $5_1$, and wherein when the mode button 2 is set at the manual position, the hook $5_1$ is operable to extend along the positive second direction X+ via the applied elastic force. In this way, the movement of the slider 12 in a negative first direction Y− can be stopped. As such, the button 2 would be locked at the manual position, this is because the hook $5_1$ is against slider 12 back. In this example, the negative first direction Y− is defined as a vertical direction pointing downwards.

Still referring to FIG. 5A, when the mode button 2 is set the manual position, the second block $12_2$ still presses the second switch 10 to trigger the second signal generator 10, but the cam $3_2$ no longer presses the first signal generator 9 (not shown). In this case, the non-triggered first signal generator 9 and the triggered second signal generator 10 together are configured to indicate that the mode button 2 is set the manual position.

As further illustrated in FIG. 5A, the apparatus may further include a second pressure spring 8 arranged in the first direction Y, with one end coupled to the mode button 2 and the other end coupled to the frame 1. In this example, the second pressure spring 8 is vertically arranged between a rod 6 and the mode button 2.

In this case, when the mode button 2 is set the manual position, the second pressure spring 8 is compressed to apply an elastic force to the mode button 2 in the negative first direction Y−. However, due to the fact that the hook $5_1$ still blocks the slide 12, the mode button 2 cannot be moved downward to for the example the service position.

Now referring to FIG. 5B, when the handle 11 is back to the frame 1, the handle 11 is operable to push the rod 5 in a negative second direction X− to cause the hook $5_1$ to move away from the slider 12, so as to allow the movement of the slider 12 in the negative first direction Y−. Once the slider 12 is allowed to move downward to the service position, the second pressure spring 8 will cause the mode button 2 to move right to the service position, without causing the mode button 2 to move any further. From the service position, user can only manually switch the mode button 2 down to the automatic position.

Now referring back to FIG. 1B, when the mode button 2 is back at the automatic position (or the bottom position) from the service position, the cam $3_2$ is operable to release the first signal generator 9, and the second block $12_2$ is also operable to release the second switch 10. The non-triggered first signal generator 9 and the non-triggered second signal generator 10 are configured to indicate that the mode button 2 is set the automatic position.

What is claimed is:

1. An apparatus for use in a switch, comprising:

a handle including a first slot;

a mode button operable to change an operation mode of the switch, the mode button including a second slot;

a slider coupled to the mode button and movable in a first direction in association with a movement of the mode button, the slider including a first block;

a lever operable to be opened in a rotatable manner and including a pin, wherein when the mode button is set at a service position, the first block is received in the first slot to maintain the handle; and in response to the lever being opened in the rotatable manner, the pin is operable to pass through the second slot to prevent the movement of the mode button.

2. The apparatus according to claim 1, further comprising:

a first signal generator; and a second signal generator, wherein the lever further includes a cam, and the slider further includes a second block, wherein in response to the pin passing through the second slot, the cam is operable to press the first signal generator to trigger the first signal generator, and the second block is configured to press the second signal generator to trigger the second signal generator, and the triggered first signal generator and the triggered second signal generator indicate that the mode button is set at the service position.

3. The apparatus according to claim 2, further comprising:

a rod arranged against the handle in a second direction; and a first spring coupled to the rod and operable to apply an elastic force to the rod in a positive second direction, wherein when the mode button is set at a manual position, the first block is configured to be released from the first slot to enable the rod to push the handle away from a frame of the apparatus via the applied elastic force.

4. The apparatus according to claim 3, wherein the rod includes a hook, and wherein when the mode button is set at the manual position, the hook is configured to extend along the positive second direction via the applied elastic force, to stop a movement of the slider in a negative first direction.

5. The apparatus according to claim 4, further comprising a second spring arranged in the first direction, with one end coupled to the mode button and another end coupled to the frame, wherein when the mode button is set at the manual position, the second spring is configured to apply an elastic force to the mode button in the negative first direction.

6. The apparatus according to claim 5, wherein when the handle is back to the frame, the handle is configured to push the rod in a negative second direction to cause the hook to move away from the slider, so as to allow the movement of the slider in the negative first direction, and the second spring is configured to cause the movement of the mode button to the service position.

7. The apparatus according to claim 3, wherein when the mode button is set at the manual position, the cam is configured to release the first signal generator, and the second block is configured to press the second signal generator to trigger the second signal generator, and the non-triggered first signal generator and the triggered second signal generator are configured to indicate that the mode button is set at the manual position.

8. The apparatus according to claim 2, wherein when the mode button is set at an automatic position, the cam is configured to release the first signal generator, and the second block is configured to release the second signal generator, and the non-triggered first signal generator and the non-triggered second signal generator are configured to indicate that the mode button is set at the automatic position.

9. The apparatus according to claim 1, further comprising:

a torsion spring coupled to the lever and configured to apply a torsional force against an opening of the lever, wherein the lever further includes at least one hole configured to receive a padlock, to facilitate in maintaining the lever at its opening status.

10. A switch comprising the apparatus according to claim 1.

11. The switch according to claim 10, further comprising:

a first signal generator; and a second signal generator, wherein the lever further includes a cam, and the slider further includes a second block, wherein in response to the pin passing through the second slot, the cam is operable to press the first signal generator to trigger the first signal generator, and the second block is configured to press the second signal generator to trigger the second signal generator, and the triggered first signal generator and the triggered second signal generator indicate that the mode button is set at the service position.

12. The apparatus according to claim 11, further comprising:

a rod arranged against the handle in a second direction; and a first spring coupled to the rod and operable to apply an elastic force to the rod in a positive second direction, wherein when the mode button is set at a manual position, the first block is configured to be released from the first slot to enable the rod to push the handle away from a frame of the apparatus via the applied elastic force.

13. The switch according to claim 12, wherein the rod includes a hook, and wherein when the mode button is set at the manual position, the hook is configured to extend along the positive second direction via the applied elastic force, to stop a movement of the slider in a negative first direction.

14. The switch according to claim 13, further comprising a second spring arranged in the first direction, with one end coupled to the mode button and another end coupled to the frame, wherein when the mode button is set at the manual position, the second spring is configured to apply an elastic force to the mode button in the negative first direction.

15. The switch according to claim 14, wherein when the handle is back to the frame, the handle is configured to push the rod in a negative second direction to cause the hook to move away from the slider, so as to allow the movement of the slider in the negative first direction, and the second spring is configured to cause the movement of the mode button to the service position.

16. The switch according to claim 12, wherein when the mode button is set at the manual position, the cam is configured to release the first signal generator, and the second block is configured to press the second signal generator to trigger the second signal generator, and the non-triggered first signal generator and the triggered second signal generator are configured to indicate that the mode button is set at the manual position.

17. The switch according to claim 11, wherein when the mode button is set at an automatic position, the cam is configured to release the first signal generator, and the second block is configured to release the second signal generator, and the non-triggered first signal generator and the non-triggered second signal generator are configured to indicate that the mode button is set at the automatic position.

18. The switch according to claim 10, further comprising: a torsion spring coupled to the lever and configured to apply a torsional force against an opening of the lever, wherein the lever further includes at least one hole configured to receive a padlock, to facilitate in maintaining the lever at its opening status.

* * * * *